United States Patent [19]

Norimatsu et al.

[11] 4,096,834

[45] Jun. 27, 1978

[54] AIR-TO-FUEL RATIO FEEDBACK CONTROL SYSTEM FOR INTERNAL COMBUSTION ENGINES

[75] Inventors: Hideaki Norimatsu; Mitsuo Nakamura, both of Kariya; Toshio Kondo, Anjyo; Akira Masuda, Aichi; Sigenori Kitajima, Kariya, all of Japan

[73] Assignee: Nippondenso Co., Ltd., Kariya, Japan

[21] Appl. No.: 742,120

[22] Filed: Nov. 15, 1976

[30] Foreign Application Priority Data

Nov. 25, 1975 Japan ..... 50-141433

[51] Int. Cl.[2] ..... F02B 3/00; F02D 33/00

[52] U.S. Cl. ..... 123/32 EE; 60/276

[58] Field of Search ..... 123/32 EE, 32 EB, 32 EA, 123/32 EL, 119 B; 60/276

[56] References Cited

U.S. PATENT DOCUMENTS

| | | | |
|---|---|---|---|
| 3,703,162 | 11/1972 | Aono | 123/32 EL |
| 3,827,237 | 8/1974 | Linder et al. | 123/32 EE |
| 3,939,654 | 2/1976 | Creps | 60/276 |
| 3,948,228 | 4/1976 | Luchaco | 123/32 EE |
| 3,949,551 | 4/1976 | Eichler et al. | 123/32 EE |
| 4,031,866 | 6/1977 | Asano | 123/32 EB |

*Primary Examiner*—Charles J. Myhre
*Assistant Examiner*—R. A. Nelli
*Attorney, Agent, or Firm*—Cushman, Darby & Cushman

[57] ABSTRACT

An internal combustion engine having an air-fuel mixture supply controller is provided with an air-to-fuel ratio detector for detecting the oxygen content in the exhaust gas of the engine and a feedback controller for correcting mixture supply operation of the mixture supply controller in response to the oxygen content. A halt circuit and a hold circuit, being responsive to first and second operating conditions of the engine respectively, are connected to the feedback controller to halt and hold the feedback control, thus causing the mixture supply controller to supply the richer or leaner mixture as desired.

14 Claims, 5 Drawing Figures

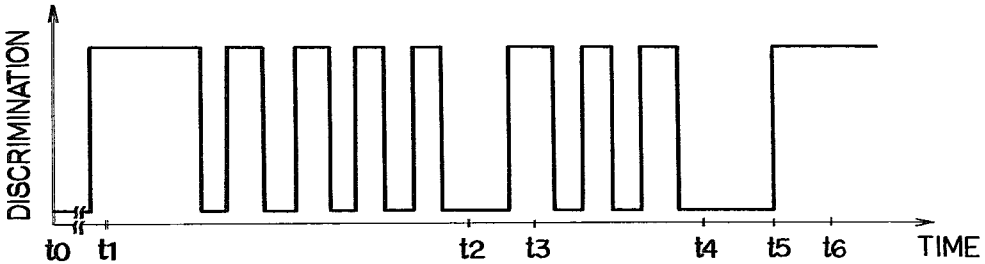
FIG. 4-A
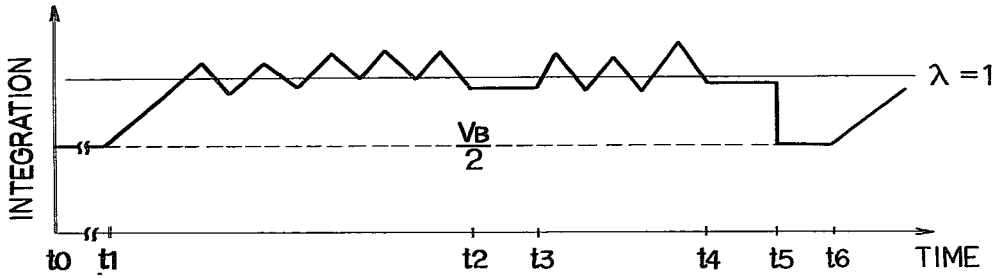
FIG. 4-B

AIR-TO-FUEL RATIO FEEDBACK CONTROL SYSTEM FOR INTERNAL COMBUSTION ENGINES

BACKGROUND OF THE INVENTION

The present invention relates to an air-to-fuel ratio feedback control system for internal combustion engines, wherein feedback control is held and stopped during respective preselected operating conditions of the engine.

It is a well-known art in the field related to internal combustion engines that the air-to-fuel ratio of air-fuel mixture is controlled in accordance with the oxygen content in the exhaust gas of the engine for the purpose of reducing noxious components therein. These techniques are disclosed widely, in U.S. Pat. No. 3,815,561 and U.S. Pat. No. 3,782,347 for instance. It must be noted, however, that the engine is constantly supplied with the air-fuel mixture of the stoichiometric air-to-fuel ratio according to these techniques, whereas it requires the mixture richer or leaner than the stoichiometric one during some operating conditions of the engine.

SUMMARY OF THE INVENTION

It is, therefore, a primary object of this invention to provide a system, wherein an engine is supplied with air-fuel mixture of various air-to-fuel ratio in accordance with operating conditions.

It is another object of this invention to provide a system, wherein air-to-fuel ratio feedback control is stopped and held during respective preselected operating conditions.

It is a further object of this invention to provide a system, wherein air-to-fuel feedback control is stopped during each one of engine starting, engine warm-up and inoperativeness of a ratio detector.

It is a still further object of this invention to provide a system, wherein air-to-fuel feedback control is held constant during full opening and full closing of a throttle valve.

BRIEF DESCRIPTION OF THE DRAWINGS

In the drawings:

FIG. 4 is a chart showing signal waveforms (A) and (B) for use in explaining the operation of the circuits shown in FIG. 2.

DETAILED DESCRIPTION OF THE PREFERRED EMBODIMENT

Figure 1:
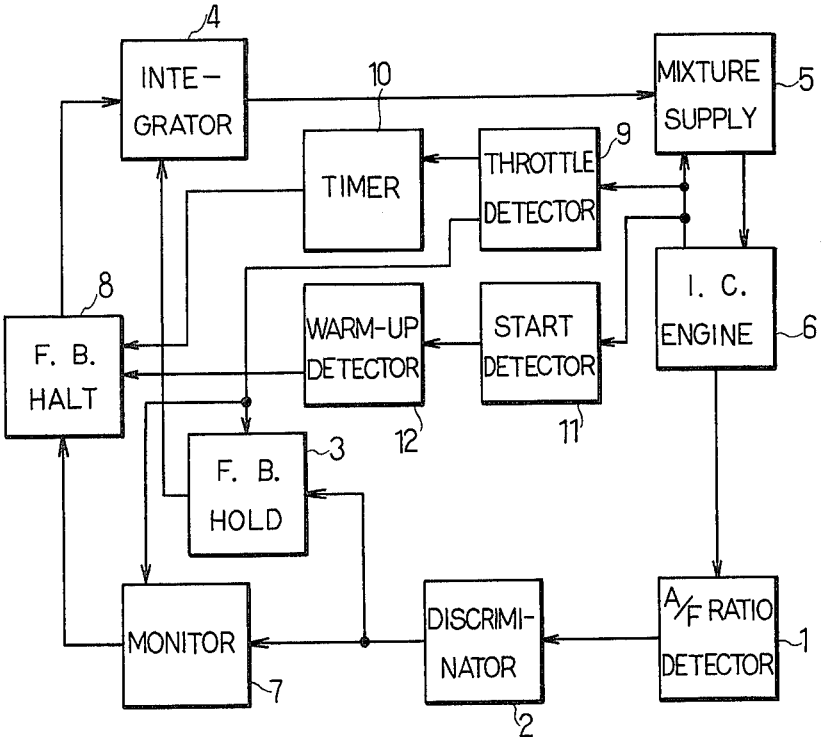
FIG. 1 is a block diagram schematically illustrating one preferred embodiment according to this invention.

Reffering first to FIG. 1, an internal combustion engine 6 is provided with a mixture supply controller 5 at the intake side thereof. The mixture supply controller 5, such as an injection device or a carburetor, is adapted to supply the engine 6 with air-fuel mixture air-to-fuel ratio characteristics of which is preset in accordance with operating conditions of the engine 6. The engine 6 is further provided with an air-to-fuel ratio detector 1 at the exhaust side thereof. The ratio detector 1 is adapted to be responsive to the oxygen content in the exhaust gas which is indicative of the air-to-fuel ratio of the mixture supplied to the engine 6. In order to correct the air-to-fuel ratio of the mixture in accordance with the oxygen content, a discrimination circuit 2 and an integration circuit 4 which constitute a well-known feedback controller are connected between the ratio detector 1 and the mixture supply controller 5 and the mixture supply controller 5 is adapted to be responsive to this feedback controller.

Connected between the discrimination circuit 2 and the integration circuit 4 is a feedback hold circuit 3 which is controllable by a throttle detector 9. The hold circuit 3 disconnects electric connection between the circuits 2 and 4 in accordance with the movement of a throttle valve (not shown) with which the throttle detector 9 is associated.

Also connected between the discrimination circuit 2 and the integration circuit 4 are a monitor circuit 7 and a feedback halt circuit 8 for stopping the operation of the integration circuit 4. The monitor circuit 7 monitors the operation of the ratio detector 1 through the discrimination circuit 2 to detect the inoperativeness of the detector 1. A timer circuit 10 is connected between the throttle detector 9 and the halt circuit 8 to detect the deceleration duration of the engine 6. A start detector 11 for detecting the starting operation of the engine 6 and a warm-up detector 12 for detecting warm-up operation of the engine 6 are connected to the halt circuit 8. The halt circuit 8, as a result, is controllable by the monitor circuit 7, the timer circuit 10, the start detector 11 and the warm-up detector 12.

Figure 2:
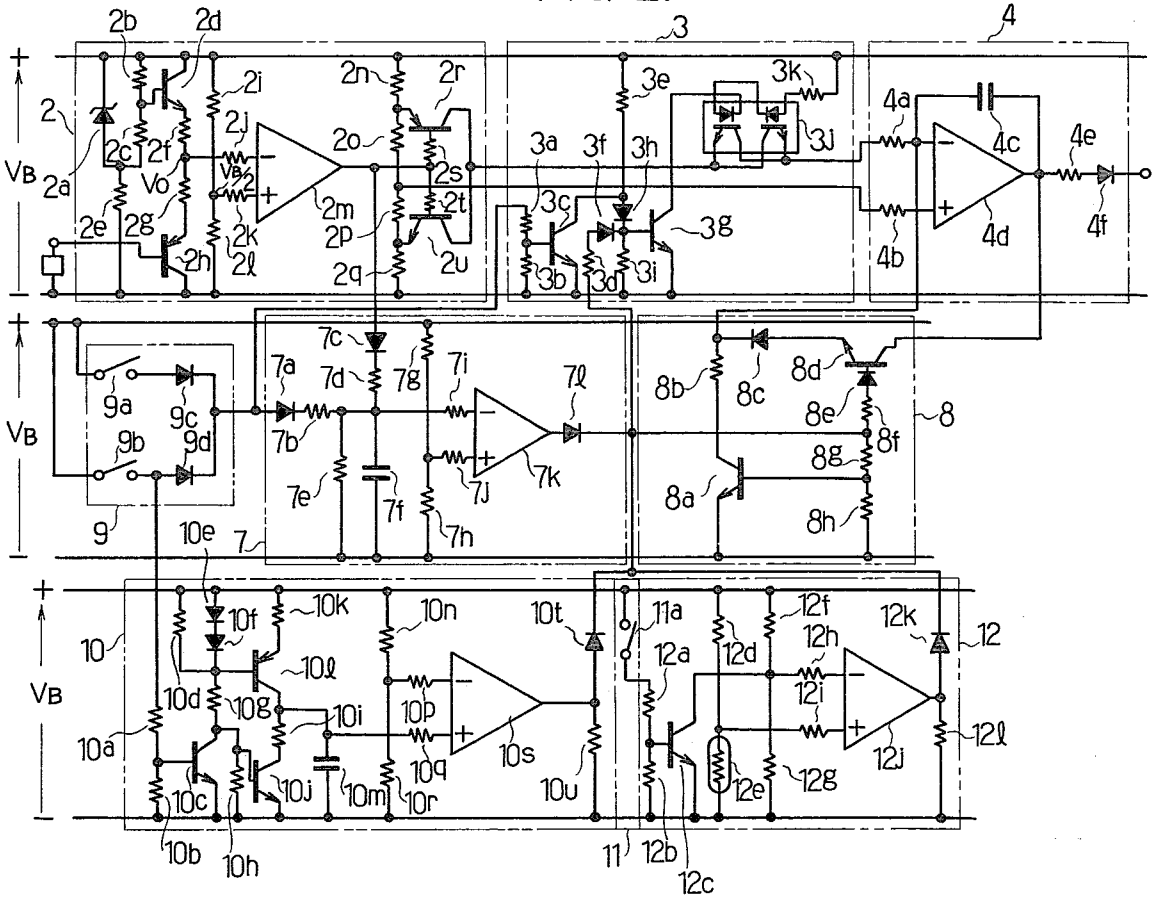
FIG. 2 is an electric wiring diagram showing detailed circuit construction of this invention shown in FIG. 1.

Referring next to FIG. 2, detailed construction and operation of each circuits shown in FIG. 1 are described hereinbelow.

The discrimination circuit 2, connected to the ratio detector 1 such as an oxygen-responsive sensor, is comprised of a zener diode **2*a*, resistors 2*b*, 2*c*, 2*e*, 2*f*, 2*g*, 2*i*, 2*j*, 2*k*, 2*l*, 2*n*, 2*o*, 2*p*, 2*q*, 2*s* and 2*t*, transistors 2*d*, 2*h*, 2*r* and 2*u* and a comparator 2*m*. The comparator 2*m* is applied with the constant voltage $^{V}B/_{2}$ ($^{V}B$: regulated voltage) appearing at the junction of resistors 2*j* and 21 at the non-inverting input (+) and the variable voltage $V_O$ appearing at the junction of the resistors 2*f* and 2*g*. The voltage $V_O$ is dependent on the output voltage of the detector 1, since the resistor 2*g* is connected to the detector 1 through the base-emitter path of the transistor 2*h*. The comparator 2*m*, as a result, produces a low voltage when the detector 1 produces a high voltage indicative of the absence of the oxygen in the exhaust gas, whereas it produces a high voltage when the detector 1 produces a low voltage indicative of the presence of the oxygen. The transistor 2*r* is rendered conductive in response to the low voltage applied from the comparator 2*m*, whereas the transistor 2*u* is rendered conductive in response to the high voltage applied from the comparator 2*m***. It must be understood herein that the absence and the presence of the oxygen are representative of the air-fuel mixture richer and leaner than the stoichiometric, respectively.

The hold circuit 3 is comprised of resistors **3*a*, 3*b*, 3*d*, 3*e*, 3*i* and 3*k*, transistors 3*c* and 3*g*, diodes 3*f* and 3*h* and a conventional photo-coupler 3*j*. Photo-coupler 3*j* is suitably of the type comprising a photo-diode which emits light in response to electric current flowing therethrough cooperating with a photo-transistor which is rendered conductive by the light emitted by the photo-diode, such as the OPTO-COUPLER 3N220 produced by Texas Instruments. As shown in FIG. 2, the photo-diodes of photo-coupler 3*j* are coupled to transistor 3*g*** and resistor 3*k*. Current flows through the photo-diodes in response to conduction through transistor 3*g*, thus rendering the photo-transistors of the photo-coupler 3*j* conductive. Conversely, when transistor 3*g* is nonconductive, no current flows through the photo-diodes and the photo-transistors are also rendered nonconductive. Photo-coupler 3*j* thus functions, in effect, as a switch to selectively transmit the output voltage of comparator 2 to integrator 4. Integration circuit 4 is comprised of resistors 4*a*, 4*b* and 4*e*, a capacitor 4*c*, an operational amplifier 4*d* and a diode 4*f*. The amplifier 4*d* is applied with the voltage appearing at the junction of the collectors of the transistors 2*r* and 2*u* through the photocoupler 3*j* and the constant voltage $^{V}B/_{2}$ appearing at the junction of the resistors 2*o* and 2*p*. The capacitor 4*c* connected across the amplifier 4*d* charges and discharges in response to input voltage changes. The integration circuit 4 integrates the output voltage of the discrimination circuit 2 with respect to time during the conduction of the photo-coupler 3*j* and produces output voltage which changes in opposite changing directions. That is, the integration output voltage keeps decreasing during the conduction of the transistor 2*r*, whereas it keeps increasing during the conduction of the transistor 2*u*. It must be noted, however, that the output voltage of the discrimination circuit 2 is cut off by the hold circuit 3 during the nonconduction of the photo-coupler 3*j* and the capacitor 4*c* does not charge nor discharge. The integration circuit 4 holds or maintains the integration output voltage, while the hold circuit 3 disconnects the electrical connection between the circuits 2 and 4. The throttle detector 9 for controlling the operation of the hold circuit 3, on-off operation of the photo-coupler 3*j* in particular, is comprised of a first and a second switches 9*a* and 9*b*, coupled to the throttle valve and diodes 9*c* and 9*d*. The first switch 9*a* is adapted to close while the throttle valve is fully opened for engine acceleration, whereas the second switch 9*b* is adapted to close while the throttle valve is fully closed for engine idling and engine deceleration. As a result, the throttle detector 9 generates a high voltage which renders the transistors 3*c* and 3*g* of the hold circuit 3 conductive and nonconductive, respectively. When the photo-coupler 3*j* is rendered nonconductive during the nonconduction of the transistor 3*g*, the output voltage of the integration circuit 4 is maintained while the throttle valve is fully closed or opened. The integration output voltage does not change during this period, even though the output voltage of the ratio detector changes.

The monitor circuit 7 is comprised of diodes 7*a*, 7*c* and 7*l*, resistors 7*b*, 7*d*, 7*e*, 7*g*, 7*h*, 7*i* and 7*j*, a capacitor 7*f* and a comparator 7*k* which receives a constant voltage across the resistor 7*h* and a variable voltage across the capacitor 7*f*. The capacitor 7*f* is connected to the discrimination circuit 2 and the throttle detector 9 to be charged by the output voltages thereof. Owing to the fact that the ratio detector 1 (oxygenresponsive sensor) is inoperative during low temperature (below some 300° C) because of high impedance thereof, the comparator 2*m* of the discrimination circuit 2 keeps generating a low voltage by which the capacitor 7*f* cannot be charged. Therefore the voltage across the capacitor 7*f* is low enough to cause the comparator 7*k* to produce a high voltage during the inoperative condition of the detector 1. This high voltage is indicative of the inoperativeness of the detector 1. It is a well-known fact on the other hand that the detector 1 is operative during high temperature and produces the output voltage which alternatively changes high and low. One cycle period of this output voltage is much shorter in general than the period in which the detector 1 becomes responsive to the oxygen content in the exhaust gas. For this reason the comparator 7*k* produces a low voltage during the normal operation of the detector 1, provided that the discharging time constant of the capacitor 7*f* is set rather long and the constant voltage across the resistor 7*h* is set rather low. This low voltage is indicative of the operativeness of the detector 1.

The halt circuit 8 adapted to control the integration circuit 4 is comprised of transistors 8*a* and 8*d*, resistors 8*b*, 8*f*, 8*g* and 8*h* and diodes 8*c* and 8*e*. The transistors 8*a* and 8*d* are so inter-connected as that both are rendered conductive to short-circuit the capacitor 4*c* of the integration circuit 4 in response to the application of high voltage thereto. Receiving the high voltage from the monitor circuit 7, the transistors 8*a* and 8*d* become conductive to cause the capacitor 4*c* to discharge therethrough. Therefore the integration circuit 4 produces the constant voltage $^{V}B/_{2}$ even while the output voltage of the discrimination circuit 2 is applied through the hold circuit 3. Integrating operation of the circuit 4 is thus stopped by the halt circuit 8 while the ratio detector 1 is inoperative. This halt circuit 8 is further adapted to be controllable by other circuits 10, 11 and 12. The timer circuit 10 is comprised of resistors 10*a*, 10*b*, 10*d*, 10*h*, 10*i*, 10*k*, 10*n*, 10*p*, 10*q*, 10*r* and 10*u*, transistors 10*c*, 10*j* and 10*l*, diodes 10*e*, and 10*f* and 10*t*, a capacitor 10*m* and a comparator 10*s*. The transistor 10*c* is connected to the second switch 9*b* of the throttle detector 9 to be rendered conductive while the switch 9*b* is closed. The transistor 101 is connected to the transistor 10*c* to be rendered conductive in response to the conduction of the transistor 10*c*, whereas the transistor 10*j* is connected to the same to be rendered nonconductive contrary to the transistor 101. The capacitor 10*m* is charged through the transistor 101 during the closure of the second switch 9*b* and discharged through the transistor 10*j* during the opening of the same switch 9*b*. As the closing period of the switch 9*b* becomes long, the voltage across the capacitor 10*m* becomes high to exceed the constant voltage across the resistor 10*r*. That is, the comparator 10*s* produces a high voltage at the time when the closing period of the throttle valve has exceeded the predetermined time period. This high voltage is applied to the halt circuit 8 to stop the integrating operation of the integration circuit 4.

The start detector 11 is comprised of a switch which is adapted to close when a starter motor (not shown) is driven and the warm-up detector 12 is comprised of resistors 12*a*, 12*b*, 12*d*, 12*f*, 12*g*, 12*h*, 12*i* and 12*l*, a transistor 12*c*, a thermally sensitive resistor 12*e* adapted to detect engine coolant temperature, a comparator 12*j* and a diode 12*k*. During engine starting the switch 11*a* closes to provide a high voltage which renders the transistor 12*c* conductive. The voltage across the resistor 12*g* becomes lower than the voltage across the resistor 12*e* during the conduction of the transistor 12*c* and the comparator 12*j* produces a high voltage. Since the resistance of the resistor 12*e* becomes low as the engine coolant temperature becomes high, the comparator 12*j* produces the high voltage until when the voltage across the resistor 12*e* becomes lower than that of the resistor 12*g*. This high voltage produced by the comparator 12*j* is indicative of either engine starting or engine warm-up and is applied to the halt circuit 8 to stop the integrating operation of the circuit 4.

It can be easily understood from the foregoing description that the halt circuit 8 stops integrating operations of the circuit 4 to thereby control the integration output voltage to the present constant value $^{V}B/_{2}$ during preselected first operating conditions of the engine and that the hold circuit 3 prevents the air-to-fuel ratio detection signal from being applied to the circuit 4 during preselected second operating conditions of the engine to thereby maintain the integration output voltage which is equal to the one of the time when one of the second operating conditions is detected. For this reason the hold circuit 3 and the halt circuit 8 can be illustrated as respective switches 3' and 8' for simplification only as in FIG. 3, wherein same numerals designate the same component parts shown in FIG. 2.

Figure 3:
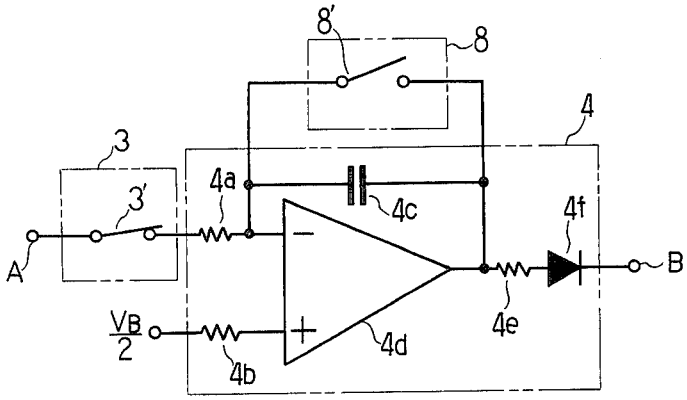
FIG. 3 is an electric wiring diagram schematically illustrating some parts of circuits shown in FIG. 2.

Overall feedback control operation of the system is described hereinunder with reference to FIG. 3 and FIG. 4 in which signal waveform (A) of the discrimination circuit 2 and signal waveform (B) of the integration circuit 4 are shown with respect to the time.

It is first assumed that the engine 6 is started at the time $t_0$ and warmed up until the time $t_1$. During this time period $t_0$–$t_1$ the switch 8' which is normally-open type closes to stop the integrating operation and to apply the constant voltage $^{V}B/_{2}$ to the input terminal B of the mixture suply controller 5. Adjusting the controller 5 to be responsive to the voltage difference between the input voltage of the terminal B and the constant voltage $^{V}B/_{2}$, it is made possible that the controller 5 doesn't correct the air-to-fuel ratio of the mixture during the period $t_0$–$t_1$. The engine 6 is therefore supplied with the mixture of the ratio desired and preset. The controller 5 is preset to supply the richer mixture during the engine starting for example.

Assuming next that the ratio detector 1 is operative and the engine 6 is operating normally during the time period $t_1$–$t_2$, the hold circuit 3 receives the discrimination output voltage shown in (A) of FIG. 4 at a terminal A and applies to the integration circuit 4 through the normally-closed switch 3'. The discrimination output voltage in (A) of FIG. 4 changes high and low in accordance with the output voltage of the detector 1 and the preset voltage corresponding to the stoichiometric air-to-fuel ratio. It must be recalled that the high level voltage and the low level voltage in (A) of FIG. 4 are indicative of the leaner mixture and the richer mixture, respectively. The integration circuit 4, integrating this output voltage with respect to time, producesthe output voltage as shown in (B) of FIG. 4. The integration output voltage increases from the preset constant voltage $^{V}B/_{2}$ after the time $t_1$ in response to high input voltage and thereafter changes changing direction in accordance with input voltage level. The mixture supply control 5 adapted to supply the mixture leaner than the stoichiometry and to correct fuel supply amount in response to the integration output voltage, for example, gradually increases and decreases the fuel supply amount while the comparison voltage remains high and low, respectively. As a result the air-to-fuel ratio of the mixture is controlled toward the preset value, the stoichiometric ratio ($\lambda = 1$).

Provided that the throttle valve of the engine 6 is fully closed or opened at the time $t_2$ upon respective deceleration or acceleration, the switch 3' of normally-closed type opens and cuts off the discrimination output voltage applied to the terminal A. The integration circuit 4, therefore, maintains the integration voltage as shown in (B) of FIG. 4 until the time $t_3$ when the switch 3' is released to close again. The mixture supply controller 5 corrects the air-to-fuel ratio of the mixture in response to the maintained integration voltage which is not dependent on the change of the discrimination output voltage. Since the mixture supply controller 5 is so designed as to supply the richer mixture upon engine acceleration, it rarely occurs that the mixture becomes too lean due to the integration voltage indicative of the decrease of the fuel. Holding the integration voltage during the time period $t_2$–$t_3$ becomes advantageous when the air-to-fuel ratio feedback control is established again at the time $t_3$. That is, the air-to-fuel ratio of the mixture is returned to the stoichiometric ratio in a very short time period after the time $t_3$, because the integration voltage has been maintained near the value indicative of the stoichiometry.

As in the case during the period $t_1$–$t_3$, the engine 6 is supplied with the stoichimetric mixture during the time period $t_3$–$t_4$ in which the engine 6 operates normally and the integration voltage is held again during the time period $t_4$–$t_5$ in which the switch 3' opens. It is assumed again that the throttle valve of the engine 6 is fully closed at the time $t_4$ and that the closing duration $t_4$–$t_5$ exceeds the time period which is preset by the timer circuit 10. The integration voltage is maintained during the period $t_4$–$t_5$ and thereafter forcibly controlled to the constant value $^{V}B/_{2}$ due to the closure of the switch 8' which is controllable by the timer circuit 10. Since the integration voltage is maintained by the capacitor 4c, the voltage is apt to change due to the leakage thereof as the time passes. Therefore holding the integration voltage too long is not desirable to prevent the feedback control from being resumed from the erroneous integration voltage. Due to the operation of the timer circuit 10, holding the integration voltage is limited to the preset time period and thereafter the integration voltage is kept to the constant voltage $^{V}B/_{2}$ upon which the mixture supply controller 5 does not depend for correcting the ratio of the mixture. As a result the engine 6 is supplied with the mixture the ratio of which is preset by the controller 5 during the period $t_5$–$t_6$ and the feedback control after the time $t_6$ is resumed in the same manner as has been described hereinabove with respect to the period $t_1$–$t_4$.

It would be easily understood from the foregoing description that halting the feedback control is accomplished during the preselected first operating conditions which generally last rather long and holding the constant feedback control is accomplished during the preselected second operating conditions which generally last rather short, resulting in the feedback control which is well-matched to various operating conditions of the engine. It must be also understood that other operating conditions of the engine, moving speed of the throttle valve for instance, may be added for halting and holding the feedback control without departing the scope of this invention.

We claim:

1. An air-to-fuel ratio feedback control system for internal combustion engines comprising:

means for detecting the air-to-fuel ratio of air-fuel mixture supplied to an internal combustion engine;

means for comparing the detected ratio with a preset ratio indicative of the stoichiometric air-to-fuel ratio;

means for integrating the comparison results continuously with respect to time, the integration output value changing in increasing and decreasing directions in accordance with the change in the comparison result;

means for detecting a preselected first operating condition of said engine;

means for detecting a preselected second operating condition of said engine, said second operating condition being indicative of the position of a throttle valve of said engine;

means for controlling the integration output value of said integrating means to a preset constant value during said first operating condition irrespective of the comparison result;

means for holding the integration output value of said integrating means unchanged during said second operating condition irrespective of the comparison result, the unchanged integration output valve being equal to a value produced just before said second operating condition is detected; and means for supplying said engine with air-fuel mixture of a ratio corrected in accordance with the difference between the integration value and the preset constant value, whereby said mixture supplying means is enabled during said first and second operating conditions, to supply the air-fuel mixture to the air-to-fuel ratio of which is other than the stoichiometric ratio.

2. An air-to-fuel ratio feedback control system as set forth in claim 1, wherein said first operating condition detecting means includes;

monitoring means, connected to said comparing means, for monitoring the period during which the comparison result is held unchanged;

start detecting means for detecting the starting operation of said engine;

temperature detecting means for detecting the low temperature of said engine; and duration detecting means for detecting an excessive closing period of said throttle valve.

3. An air-to-fuel ratio feedback control system as set forth in claim 1, wherein said second operating condition detecting means includes:

a first switch, operatively coupled to said throttle valve, for detecting the full-opening of the same; and a second switch, connected to said throttle valve, for detecting the full-closing of the same.

4. An air-to-fuel ratio feedback control system as set forth in claim 1, wherein said controlling means is connected to said integrating means for stopping the integrating operation of the same during said first operating condition.

5. An air-to-fuel ratio feedback control system as set forth in claim 1, wherein said keeping means is connected between said comparing means and said integrating means for cutting off the application of the comparison result from the former to the latter during said second operating condition.

6. An air-to-fuel ratio feedback control system for internal combustion engines comprising:

a mixture supply controller for supplying an engine with air-fuel mixture in accordance with operating conditions of said engine, said mixture supply controller being adapated to correct air-to-fuel ratio of the mixture in response to a control signal;

an air-to-fuel ratio detector for detecting the oxygen content in the exhaust gas emitted from said engine;

a feedback controller, connected between said ratio detector and said mixture supply controller, for producing the control signal which is applied to the latter, signal level thereof changing with respect to time and changing direction thereof being reversed in response to the absence and the presence of the oxygen in the exhaust gas;

a halt circuit, connected to said feedback controller, for controlling the signal level of the control signal at a preset constant level during preselected first operating conditions of said engine, said preset constant level being irrespective of the oxygen content in the exhaust gas and representing that correction of the air-to-fuel ratio is zero; and a hold circuit, connected to said feedback controller, for maintaining the signal level of control signal during preselected second operating conditions of said engine, the maintained signal level being equal to the one at the time when said second operating conditions are detected and irrespective of the oxygen content in the exhaust gas detected thereafter.

7. An air-to-fuel ratio feedback control system as set forth in claim 6, wherein said feedback controller includes an integration circuit having a capacitor which is adapted to charge and discharge in response to the absence and presence of the oxygen in the exhaust gas, wherein said halt circuit includes first switching means which is connected across said capacitor to cause said capacitor to completely discharge therethrough when said first operating conditions are detected, and wherein said hold circuit includes second switching means which is connected between said ratio detector and said integration circuit to disconnect the electrical connection therebetween during said second operating conditions.

8. An air-to-fuel ratio feedback control system as set forth in claim 6, wherein said halt circuit is adapted to be responsive to inoperativeness of said ratio detector.

9. An air-to-fuel ratio feedback control system as set forth in claim 6, wherein said halt circuit is adapted to be responsive to starting operation and warm-up operation of said engine.

10. An air-to-fuel ratio feedback control system as set forth in claim 6, wherein said hold circuit is adapted to be responsive to full opening and full closing of said engine throttle.

11. An air-to-fuel feedback control system for internal combustion engines comprising:

means for generating a detection output signal indicative of the air-to-fuel ratio of air-fuel mixture supplied to an internal combustion engine as represented by the oxygen content in exhaust gases;

comparing means for generating a comparison signal indicative of the comparison of the detection output signal with a reference signal indicative of a predetermined air-to-fuel ratio;

means for selectively integrating the comparison output with respect to time, the integration output changing from a value produced at the start of integrating operation;

holding means for cutting off the comparison output during acceleration and deceleration periods of said engine to thereby hold said integration output unchanged from a value produced at the start of cut-off operation;

means for halting the integrating operation of said integrating means during starting and warm-up periods of said engine to thereby control the integration output ot a preset constant value; and means for supplying said engine with air-fuel mixture of a ratio determined in accordance with the difference between the integration output and the preset constant value.

12. An air-to-fuel ratio feedback control system as set forth in claim 11, wherein said integrating means includes an amplifier and a capacitor which is connected across the input and output of said amplifier, wherein said holding means includes a switching element connected between said comparing means and said integrating means and adapted to be rendered nonconductive during said acceleration and deceleration periods, and wherein said halting means includes another switching element connected across said capacitor of said integrating means and adapted to be rendered conductive during said starting and warm-up periods.

13. An air-to-fuel ratio feedback control system as set forth in claim 12, wherein said holding means includes a detector coupled to a throttle valve for detecting the acceleration and deceleration of said engine in response to the position of said throttle valve.

14. In an air-to-fuel ratio feedback system for an internal combustion engine, said feedback system being of the type including fuel supply means, responsive to control signals applied thereto, for supplying said engine with an air-to-fuel mixture of a ratio in accordance with said control signal, detector means for generating a comparison signal indicative of the deviation of said air-fuel ratio from the stoichiometric ratio, an integrator for integrating said comparison signal, and means for applying the integrator output signal to said fuel supply means as said control signal, the improvement wherein said feedback system further includes:

holding means, cooperating with said integrator, for cutting off said comparison signal from said integrator during periods of acceleration and deceleration to maintain thereby said control signal at its value just previous to said period of acceleration or decleration; and halting means, cooperating with said integrator for selectively inhibiting said integrator and applying as said control signal a signal of constant predetermined value during starting and warm-up periods of said engine.

* * * * *